US007533888B2

(12) United States Patent
Georgis

(10) Patent No.: US 7,533,888 B2
(45) **Date of Patent: *May 19, 2009**

(54) ROTATABLE GAMES

(76) Inventor: Nicholas J. Georgis, 215 Fox Run, Huntington, CT (US) 06484

( * ) Notice: Subject to any disclaimer, the term of this patent is extended or adjusted under 35 U.S.C. 154(b) by 0 days.

This patent is subject to a terminal disclaimer.

(21) Appl. No.: 12/050,011

(22) Filed: Mar. 17, 2008

(65) Prior Publication Data

US 2008/0224411 A1 Sep. 18, 2008

Related U.S. Application Data

(63) Continuation of application No. 11/410,737, filed on Apr. 25, 2006, now Pat. No. 7,350,786.

(60) Provisional application No. 60/679,051, filed on May 9, 2005.

(51) Int. Cl.
*A63F 9/00* (2006.01)

(52) U.S. Cl. ..... 273/444; 273/440; 273/441; 273/459; 273/461

(58) Field of Classification Search ..... 273/109, 273/440, 441, 444, 459–461; 472/28, 29, 472/1, 92, 127; 482/146–148; 463/1, 2, 463/7

See application file for complete search history.

(56) References Cited

U.S. PATENT DOCUMENTS

| | | | | |
|---|---|---|---|---|
| 2,175,197 | A | 10/1939 | Kent, Jr. | |
| 3,633,905 | A | 1/1972 | Etchelecou | |
| 3,761,084 | A | 9/1973 | Dieckmann | |
| 3,806,118 | A | 4/1974 | Way | |
| 3,887,179 | A | 6/1975 | Klepper et al. | |
| 4,202,543 | A | 5/1980 | Collins | |
| 4,281,830 | A | 8/1981 | Rehbein | |
| 4,767,117 | A | 8/1988 | Maio | |
| 4,787,631 | A | 11/1988 | Erumsele | |
| 5,334,100 | A | 8/1994 | Bailey | |
| 5,676,601 | A | 10/1997 | Saunders | |
| 6,007,438 | A | 12/1999 | Harrell | |
| 6,866,594 | B2 | 3/2005 | Greenwood | |
| 7,350,786 | B1 * | 4/2008 | Georgis | 273/444 |

* cited by examiner

*Primary Examiner*—Raleigh W. Chiu
(74) *Attorney, Agent, or Firm*—Blakely Sokoloff Taylor & Zafman LLP

(57) ABSTRACT

By providing a playing surface which is dimensioned for enabling a desired game to be played with all competitors positioned thereon, with the playing surface being rotated, a competitive game and/or playing system/environment is created which enables all individuals to compete equally and fairly regardless of their physical capabilities. In the preferred embodiment, the rotation of the playing surface is maintained at a constant rate of speed, although added dimensions and difficulties can be added to the game by altering the rotational speed of the playing surface during the competition. By providing a playing surface upon which any desired game can be played, particularly an action oriented game, with the playing surface being continuously rotated throughout the play of the game, forces previously unknown to each competitor are continuously imposed on each competitor, effectively rendering each competitor to possess equal capabilities, regardless of their strength, agility, proficiency, or size.

21 Claims, 1 Drawing Sheet

ROTATABLE GAMES

CROSS-REFERENCE TO RELATED APPLICATIONS

Figure 1:
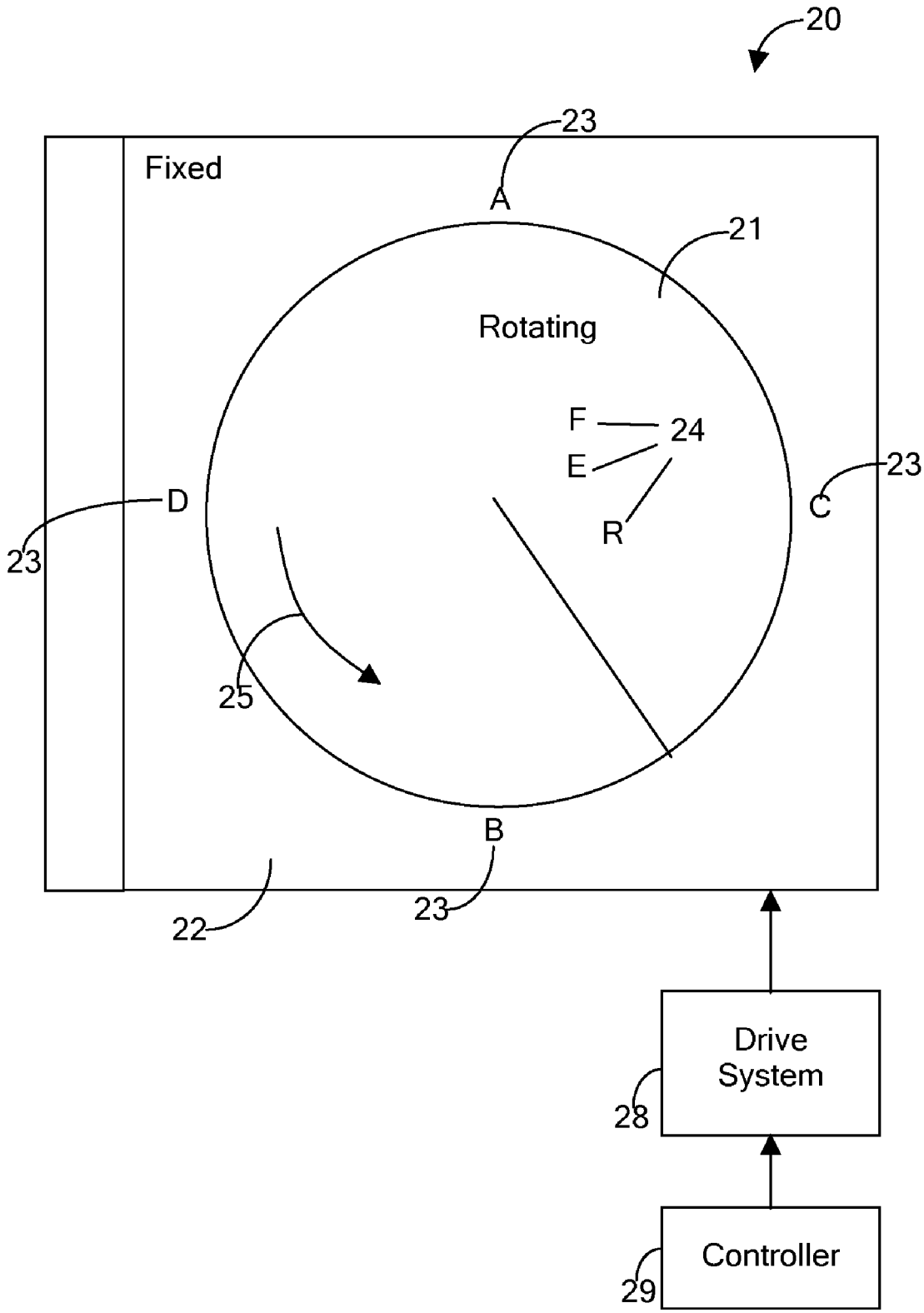

This application is a continuation of U.S. patent application Ser. No. 11/410,737 filed Apr. 25, 2006, now allowed, which further claims the priority benefit of U.S. Provisional Patent Application Ser. No. 60/679,051, filed May 9, 2005 entitled ROTATABLE GAMES.

BACKGROUND ART

A wide variety of games have been developed for enabling individuals to compete in numerous activities which require a wide range of varying skills or accomplishments. However, in virtually all of these the competitive games, individuals having greater proficiency, strength, agility, size, etc. are typically the winner. Unfortunately, no competitive game has been developed which enables all individuals to compete on an equal basis, regardless of their physical strengths and/or individual characteristics or capabilities.

Although attempts have been made to provide competitive games which enable individuals to compete on a substantially equal basis, these priority attempts have failed to satisfy the growing need. As a result, individuals who do not excel or possess the various skills or agility which are required for most competitive games are often loners, suffer from inferiority complexes, and are frequently taunted by other individuals.

Therefore, it is a principal object of the present invention to provide a competitive game and/or playing system or environment wherein all individuals are capable of competing on an equal basis, regardless of their physical skills or agility.

Another object of the present invention is to provide a competitive game and/or playing system/environment having the characteristic features described above which is fun, exciting, and interest generating for all competitors.

Another object to the present invention is to provide a competitive game and/or playing system/environment having the characteristic features described above which enables individuals of a wide variety of skill levels and physical competence to compete equally, fairly, and in a friendly social atmosphere.

Other and more specific object will in part be obvious and will in part appear hereinafter.

SUMMARY OF THE INVENTION

By employing the present invention, all of the difficulties, drawbacks, and failures of the prior art are overcome and a competitive game and/or playing system/environment is created which enables all individuals to compete equally and fairly regardless of their physical capabilities. In accordance with the present invention, this desirable and long sought goal is achieved by providing a playing surface which is dimensioned for enabling a desired game to be played with all competitors positioned thereon, with the playing surface being rotated. In the preferred embodiment, the rotation of the playing surface would be a constant rate of speed, although added dimensions and difficulties can be added to the game by altering the rotational speed of the playing surface during the competition.

By providing a playing surface upon which any desired game can be played, particularly an action oriented game, with the playing surface being continuously rotated throughout the play of the game, forces previously unknown to each competitor are continuously imposed on each competitor, effectively rendering each competitor to possess equal capabilities, regardless of their strength, agility, proficiency, or size. In this way, all competitors are placed on a completely equal basis, having to deal with the same forces in the same environment without any training or previous expertise.

In accordance with the present invention, virtually any desired game can be played on the rotating playing surface of the present invention. By way of example, these games include basketball, football, soccer, baseball, field-goal kicking, tennis, dart throwing, archery, billiards, pool, lacrosse, horseshoe pitching, bean bag throwing, table tennis, and the like. Regardless of which game is selected for being played on the rotating playing surface of the present invention, each competitor in the game is required to deal with forces previously unknown and unexperienced by the individual. As a result, each player effectively becomes a novice and must re-adjust whatever skills or expertise the individual possesses for achieving the desired goal.

By way of an example, two individuals can be positioned on the rotatable playing field of the present invention with the playing field being constructed for an activity such as archery, dart throwing, bean bag tossing, or shooting a basketball at a backboard and hoop/basket mounted on the playing field. In each of these situations, as well as any other game desired, the target at which the individuals are seeking to reach would typically be placed at one or more locations along the outer peripheral edge of the playing field.

The competitor or competitors are preferably positioned towards the center of the playing field and attempt to hit the desired target. However, due to the forces which are caused by the rotation of the playing field, unique and interesting challenges are imposed upon each player. In this regard, each player must make numerous adjustments, deviating from their normal method for hitting the target, in order to compensate for the unexpected and unusual forces imposed thereon.

By employing the present invention, acceleration forces are experienced by each player, since a rotating surface requires acceleration. Since any object traveling in a circle is changing the direction of its velocity, forces must be acting upon the object. As a result, the object is accelerating, even though the object is not speeding up or going faster. One of the forces being experienced by the individual, as well as any object which the individual is holding and attempting to use, such as a ball, dart, arrow, bean bag, and the like, is centrifugal force.

In general, in this disclosure, the term "centrifugal force" more particularly references the fictitious centrifugal force which is used when analyzing a rotating frame of reference. In this frame of reference, the centrifugal force or fictitious centrifugal force is exerted on all objects and is directed away from the axis of rotation.

The centrifugal force is an outwardly directed force which attempts to force any person or object on the platform to move radially outwardly towards the peripheral edge. In addition, there is a sideways or tangential force which appears to be present to the person on the rotating playing field which causes the objects tossed outwardly or inwardly along radial line to rear off course either to the right or to the left. This force is the coriolis force.

In view of the imposition of these two unique and distinctly different forces acting upon any individual, as well as the object which the individual is using, each player or participant is required to deal with conditions which are completely unknown and foreign to that individual. Consequently, any prior experience or expertise in a particular game is completely irrelevant, and each player or participant is forced to compensate for these forces for the first time. As a result, substantial equality of competitive levels is realized.

In accordance with the present invention, the playing field detailed above can be constructed for physically rotating in order to achieve the goals of the present invention. In this regard, the competing players would be positioned on the rotating playing field for enabling the players to compete against each other while experiencing and dealing with the forces imposed thereon. In this way, their skill levels will be equalized and real competition will be attained.

In an alternate embodiment of the present invention, the playing field is constructed as a virtual playing field, existing as part of a software program which is displayed on an associated computer screen or other visual display. In this embodiment, various views of the playing field would be displayed, such as plan views, side views and perspective or elevation views, with the players being depicted on the rotating playing field. Competitors would use hand holdable controllers, such as joysticks or other program controllers, for effectively controlling all movements of one designated player.

In addition, the associated software effectively imposes all forces, such as centrifugal forces and coriolis forces upon both of the players and the objects which the players are using. As a result, the movement of the players and the objects with which the players are competing move in realistic directions as if the forces and the resulting conditions were actually being experienced by the individuals in real life. In this way, extremely challenging, interesting, unique, and competitive conditions are experienced by the players with neither player having any advantage over the other.

As an example of the fun, challenging and exciting games that are attainable with the present invention, I will describe a one-on-one basketball competition on a rotating platform. Although basketball is used as an example, the idea can be extended to any game where two teams compete to score baskets or goals. The players, their court (or field) and their baskets (or goals) are all located on a large rotating platform, all of which are displayed on a screen.

The game can be played from either of two perspectives. From the perspective of the fans, an overhead view of the court is provided. It is rotating on the screen. Players direct their screen character toward the appropriate basket as in regular basketball. But the court is spinning. To keep game controls simple, when the layer pushes away from himself with the joystick, the character always moves toward the opposing basket (whichever way the court happens to be facing at that instant). Similarly, other directions are fixed relative to the court. Pushing right on the stick always moves the character to the right side of the court even if that happens to be at the left side of the screen because the court is upside down on the screen at that instant. Configuring the controls this way helps to keep playing the game simple. But it lets the player out of being forced to play from the outside observer's perspective.

To do that for real, one would need to have the joystick always move the player in the direction fixed with respect to the fans in the stands which are not rotating. In other words, as I pushed the joystick away form me to run toward a basket, the rotation of the court would cause me to have to start pushing the stick to the wide to continue toward a basket that was not on the right side of the screen instead of at the top. This would be challenging to control but overall more educational and it would force the underlying agenda of trying to get the players to switch to play from the second frame of reference: one attached to the rotating court, the frame of reference that the characters would really be playing from.

Before turning to the second perspective of the game play, let me say a few final things about game play from the point of view of the fans in the stands. Which of the two method of joystick control gets adopted would ultimately have to be determined by actually trying to play the game once it is constructed. My own preference would be to force the total experience of having to adjust one's direction of push on the joystick as the court rotates. This would make for difficult player control and a desire to switch to a perspective fixed with respect to the rotating court. But as the reader will soon see, that perspective has its own difficulties and surprises.

The difficulty of playing from a fixed overhead view with difficult controls is compensated for by the fact that shooting for a basket is far easier from this outside perspective. I suggest using a red arrow to represent the direction of projection of the ball. This arrow initially appears when the player pushes a button to indicate that he intends to set up a shot. The arrow points in the direction that the character currently is facing and extends forward from the character's head (remember, this is an overhead view). The direction of this arrow can be rotated (perhaps by rotating a game control knob so that it points left or right of the direction that the character is facing. Another button then releases the shot. Varying the direction of the throw will be necessary since a player will have to "lead" a rotating basket if his character is in toward the center of the rotating court. Players will soon realize that objects (characters and basketballs) have a higher speed when they are near the edge of the court than the middle. In general, the speed of an object varies linearly with how far one is from the center of rotation. So, when one throws for a basket by aiming directly at the basket, the ball may not have enough sideways (or tangential) velocity to keep up with the basket that is at the farthest extreme distance from the center of rotation. Consider the situation in which a player attempts a basket from half court. The character holding the ball has no velocity. He is spinning around in the center but not covering any distance around the rotating disk. Thus, the ball, which is in his hands, has no tangential velocity either. A throw straight toward a basket will always result in a miss because once the ball leaves the character's hands, it will travel in a straight line (no forces are now acting on it in any horizontal direction) toward where the basket was but not where it is now. The basket may be ninety degrees around the court by the time the ball reaches where the basket was. It is even possible to shoot for one basket and have the other basket rotate into place by the time the ball gets there so that you accidentally score a basket for the other team! So, a player will need to learn to shoot ahead, where he things the basket will be. But how much ahead will depend on how far he is away from the center. If his character is right under the basket, then he does not need to lead with the shot at all. This is all because different distances out of the center on a rotating platform are traveling at different speeds. So there will be a real tradeoff in playing from this perspective. It is far easier to make a shot from closer to the basket. Of course, you have to get close to the basket and you have an opposing player who is trying to keep you from doing that according to the rules of traditional one-on-one basketball. Shoot from anywhere other than just under the basket and you better know exactly how much to lead with the shot.

As for the other perspective of game play, players will view the court as their characters see it. Imagine the game zooms in on the character with the ball. You see that character from, say, just behind his head so that you see things almost from his perspective. The crowd whirls around you. Of course, it is you that is really doing the whirling. But from this perspective, it does not look that way. Now you will have to contend with the coriolis force when you shoot for a basket. Aim straight at it from center court and you will see the ball veer off course. A strange force will push the ball sideways even though outside observers still see the ball traveling in its true, straight-line path. You will have to do the same basket leading you did from the other perspective of game play but now the reason will be totally different. Before, it was the ball that was traveling in a straight line while in the air, and the baskets that were rotating around. Now the baskets will seem fixed to you, but the ball will appear to veer to the left or right of them. The laws of physics in this rotating reference frame will include some forces that were just aspects of motion that you compensated for in the first frame of reference for playing the game.

As a final challenge, I would suggest having the court's rotation rate increase as the game goes on, obviously limited to a speed that is reasonable. At high enough speeds, even the players themselves could start to slide. The player would have to compensate with joystick motion. There are numerous possibilities.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawing, in which:

FIG. 1 is a top plan view of a playing field constructed for operating in accordance with the present invention.

DETAILED DISCLOSURE

By referring to the following detailed disclosure, along with FIG. 1, the construction and operation of the playing field of the present invention can best be understood. In addition, alterations and variations of the present invention can be made without departing from the scope of this invention. Consequently, it is to be understood that the following disclosure and the associated drawing are provided for exemplary purposes only and are not intended as a limitation of the present invention.

In its preferred embodiment, game/playing system 20 of the present invention comprises playing surface 21 which is constructed for being continuously rotated. Directly adjacent rotating playing surface 21 is fixed, non-rotating surface 22. In addition, any desired game elements are placed on either rotating surface 21 or non-rotating surface 22, while the players or game participants stand on a rotating surface 21.

As discussed above, a wide variety of games can be played using system 20. The only limitation on the games being played is the size of surfaces 21 and 22. In this regard, games such as basketball, football, soccer, baseball, field-goal kicking, tennis, dart throwing, archery, billiards, pool, lacrosse, horse shoe pitching, beanbag throwing, table tennis, and the like, all represent typical games or activities in which participants can engage.

In addition, in those games which have a target, such as archery, beanbag throwing, basketball, dart throwing, horseshoe pitching, and the like, the target can be mounted on either rotating surface 21 or on fixed, non-rotating surface 22. In the preferred embodiment, the targets are mounted on fixed, non-rotating surface 22 in one or more desirable positions or locations 23. As depicted in FIG. 1, targets are preferably mounted in four separate and independent locations 23 designated as A, B, C, D, with each location 23 being spaced substantially 90° away from each adjacent location.

By employing this construction, each participant is forced to use skills which are unnatural and have never been employed previously for that particular activity. As detailed above, the forces imposed upon each individual as the individual attempts to hit the particular target are all unique forces which place each participant on an equal level. As a result, size and prior expertise in a particular activity has virtually no significance, with all participants be required to compete with virtually identical skill levels.

As shown in FIG. 1, one or more participants 24, designated as E, F, and R, are positioned on rotating surface 21 and attempt to perform the desired activity. When surface 21 is rotated in the direction of arrow 25, each participant 24 is required to perform the designated activity, with the forces created by the rotating surface being imposed on that individual. Depending upon the activity, each individual may stand alone or, in the case of activities which would be played against a defender, all participants would be on rotating surface 21.

In addition, as shown in FIG. 1, the rotating movement of surface 21 is controlled by drive system 28 which is interconnected with controller 29 for providing the desired speed to surface 21. In this regard, controller 29 and drive system 28 are preferably created in a manner which enables the rotational speed to be maintained at a constant level or, if desired, increased and/or decreased during the game play. In this way, a wide variety of alternate challenging conditions can be imposed upon participants 24.

As detailed above, in addition to having rotating surface 21 and fixed surface 22 representing physical structures upon which participants 24 actually perform the desired activities, rotating surface 21 and fixed surface 22 can be depicted on a monitor or display for enabling the participants to compete with each other electronically, using hand-held controllers which perform the desired tasks enabling participants 24 to compete with each other.

In this construction, game/playing system 20 would be embodied in a software package, in which all the desired controls over speed and game play are included. In addition, the forces being imposed upon each player and every activity performed by the player would also be imposed by the program forming an integral component of the software. In this way, a unique exciting and highly competitive game is realized.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A game or playing system comprising:

a playing surface dimensioned for enabling a plurality of competing individuals to be fully supported during said individuals participation in one or more activities associated with said playing surface, said playing surface adapted to enable said individuals to cause a motion of one or more objects placed on said playing surface, the motion of said one or more objects being from said playing surface towards a target associated with said one or more activities, said one or more activities being fixed at positions either outside of said playing surface or on said playing surface; and a drive assembly enabling said playing surface to be continuously rotated during said one or more activities such that each of said plurality of competing individuals must adjust for the changing forces imposed thereon.

2. The game/playing system of claim 1, wherein said one or more activities comprise one or more of a group consisting of: basketball, football, soccer, baseball, field-goal kicking, tennis, dart throwing, archery, billiards, pool, lacrosse, horseshoe pitching, beanbag throwing, and table tennis.

3. The game/playing system of claim 1, wherein said one or more objects is selected from a group comprising: ball, dart, arrow, beanbag, shuttlecock, and horseshoe.

4. The game/playing system of claim 1, wherein said target is selected from a group comprising: goal, post, dartboard, basket, hole, and gate.

5. The game/playing system of claim 1, wherein said playing surface is rotated either at a constant speed constant speed or at a variable speed.

6. The game/playing system of claim 1, wherein said plurality of competing individuals are grouped in a plurality of groups including at least a first group and a second group, the first group competing against the second group.

7. The game/playing system of claim 1, further comprising an outer surface peripherally surrounding said playing surface, said outer surface maintained in a fixed, non-rotating configuration.

8. The game/playing system of claim 7, wherein said target is mounted on said outer surface.

9. A computer game comprising:

a rotating playing surface displayed on a display;

a plurality of targets associated with an activity displayed on said display at a position that is either outside of said rotating playing surface or on said rotating surface; and a plurality of hand-held controllers enabling at least one participant to cause a simulated motion of one or more displayed objects placed on said playing surface, the motion of said one or more displayed objects being from said playing surfacetowards one of the plurality of targets displayed on said display and the motion of said one or more objects being caused by a motion of said rotating playing surface and forces thereof.

10. The computer game of claim 9, wherein said activity comprise one or more of a group consisting of: basketball, football, soccer, baseball, field-goal kicking, tennis, dart throwing, archery, billiards, pool, lacrosse, horseshoe pitching, beanbag throwing, and table tennis.

11. The computer game of claim 9, wherein said one or more displayed objects is selected from a group comprising: ball, dart, arrow, beanbag, shuttlecock, and horseshoe.

12. The computer game of claim 9, wherein said plurality of targets is selected from a group comprising: goal, post, dartboard, basket, hole, and gate.

13. The computer game of claim 9, wherein said playing surface is rotated either at a constant speed or at a variable speed.

14. The computer game of claim 9, wherein a plurality of competing individuals each using one of said plurality of hand-held controllers are grouped in a plurality of groups including at least a first group and a second group, the first group competing against the second group.

15. The computer game of claim 9, further comprising a display of an arrow representing a direction of projection of said one or more displayed objects.

16. A computerized method comprising:

displaying a rotating playing surface;

displaying a plurality of targets associated with an activity at a position that is either outside of said rotating playing surface or on said rotating playing surface; and receiving inputs from a plurality of hand-held controllers that enable at least one participant to cause a simulated motion of one or more displayed objects placed on said playing surface, the motion of one or more displayed opjects being from said playing surface towards a target displayed on said display and the motion of said one or more displayed objects caused by a motion of said rotating playing surface and forces thereof.

17. The computerized method of claim 16, wherein said one or more displayed objects is selected from a group comprising: ball, dart, arrow, beanbag, shuttlecock, and horseshoe.

18. The computerized method of claim 16, wherein said plurality of targets is selected from a group comprising: goal, post, dartboard, basket, hole, and gate.

19. The computerized method of claim 16, further comprising at least one of:

rotating said playing surface at a constant speed; and rotating said playing surface at a variable speed.

20. The computerized method of claim 16, further comprising:

grouping a plurality of competing individuals each using one of said plurality of hand-held controllers in a plurality of groups including at least a first group and a second group, the first group competing against the second group.

21. The computerized method of claim 16, further comprising:

displaying of an arrow representing a direction of projection of said one or more displayed objects.

* * * * *